US009234629B2

(12) United States Patent
Cho et al.

(10) Patent No.: US 9,234,629 B2
(45) Date of Patent: Jan. 12, 2016

(54) STORAGE TANK FOR LIQUIFIED MATERIALS AND SHIP COMPRISING SAME

(75) Inventors: Tae Min Cho, Gyeongsangnam-do (KR); Bong Jae Kim, Gyeongsangnam-do (KR); Dae Sung Lee, Geoje Gyeongsangnam-Do (KR); Jae Ho Jung, Geoje Gyeongsangnam-Do (KR); Yong Suk Suh, Geoje Gyeongsangnam-Do (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 0 days.

(21) Appl. No.: 14/118,481

(22) PCT Filed: May 22, 2012

(86) PCT No.: PCT/KR2012/004017

§ 371 (c)(1), (2), (4) Date: Nov. 18, 2013

(87) PCT Pub. No.: WO2012/161493

PCT Pub. Date: Nov. 29, 2012

(65) Prior Publication Data

US 2014/0137782 A1 May 22, 2014

(30) Foreign Application Priority Data

May 25, 2011 (KR) ..... 10-2011-0049372
Jul. 21, 2011 (KR) ..... 10-2011-0072308
Oct. 26, 2011 (KR) ..... 10-2011-0109620

(51) Int. Cl.
*B63B 25/08* (2006.01)
*F17C 13/08* (2006.01)

(Continued)

(52) U.S. Cl.
CPC ..... *F17C 13/082* (2013.01); *B63B 3/68* (2013.01); *B63B 25/16* (2013.01); *F17C 13/004* (2013.01);

(Continued)

(58) Field of Classification Search
CPC ..... B63B 25/08; B63B 25/082; B63B 25/12; B63B 25/14; B63B 25/16
USPC ..... 114/72, 73, 74 R, 74 T, 74 A
See application file for complete search history.

(56) References Cited

U.S. PATENT DOCUMENTS 3,018,018 A * 1/1962 Beckwith ..... 220/560.04
3,021,808 A * 2/1962 Henry ..... 114/74 A (Continued)

FOREIGN PATENT DOCUMENTS

JP 58-124391 8/1983
JP 59-040100 3/1984

(Continued)

OTHER PUBLICATIONS

Japanese Office Action dated Jul. 3, 2014 corresponding to Japanese Appln. No. 2014-510265.

(Continued)

*Primary Examiner* — Daniel V Venne
(74) *Attorney, Agent, or Firm* — Locke Lord LLP; James E. Armstrong, IV; Howard M. Gitten

(57) ABSTRACT

A liquid cargo storage tank and a ship including the same are provided. The liquid cargo storage tank according to the present invention comprises: a body installed in a hull of a ship and having a liquid cargo receiving space by forming a space between the body and the hull; and a reinforcing plate installed in the lower part of the body in a state of being spaced apart from the underside of the body to be a floor of the liquid cargo receiving space.

15 Claims, 12 Drawing Sheets

(51) Int. Cl.

| | |
|---|---|
| ***B63B 25/16*** | (2006.01) |
| ***B63B 3/68*** | (2006.01) |
| ***F17C 13/00*** | (2006.01) |

(52) U.S. Cl.

CPC ... *F17C 2201/0157* (2013.01); *F17C 2201/052* (2013.01); *F17C 2203/0333* (2013.01); *F17C 2203/0631* (2013.01); *F17C 2203/0651* (2013.01); *F17C 2221/033* (2013.01); *F17C 2221/035* (2013.01); *F17C 2223/0153* (2013.01); *F17C 2223/0161* (2013.01); *F17C 2223/033* (2013.01); *F17C 2250/0452* (2013.01); *F17C 2250/0491* (2013.01); *F17C 2260/037* (2013.01); *F17C 2260/038* (2013.01); *F17C 2270/0105* (2013.01); *F17C 2270/0107* (2013.01)

(56) References Cited

U.S. PATENT DOCUMENTS

| | | | | | |
|---|---|---|---|---|---|
| 3,110,157 | A | * | 11/1963 | Radd | 62/53.2 |
| 3,319,430 | A | * | 5/1967 | Small | 62/45.1 |
| 3,319,431 | A | * | 5/1967 | Clarke et al. | 62/53.2 |
| 3,339,515 | A | * | 9/1967 | Reed | 114/74 A |
| 3,347,402 | A | * | 10/1967 | Forman et al. | 220/560.1 |
| 3,547,301 | A | * | 12/1970 | Roger | 114/343 |
| 3,659,543 | A | * | 5/1972 | Basile et al. | 114/74 A |
| 3,766,876 | A | | 10/1973 | Cowles | |
| 3,882,809 | A | * | 5/1975 | Johnson et al. | 114/74 A |
| 4,079,689 | A | * | 3/1978 | Llorente | 114/74 A |
| 4,404,843 | A | * | 9/1983 | Johnson et al. | 73/49.2 |
| 4,488,500 | A | | 12/1984 | Mototsuna et al. | |
| 2011/0192339 | A1 | * | 8/2011 | Chen et al. | 114/74 A |

FOREIGN PATENT DOCUMENTS

| | | | |
|---|---|---|---|
| JP | 59-160692 | A | 9/1984 |
| JP | 07-052870 | | 2/1995 |
| JP | 08-121695 | A | 5/1996 |
| KR | 10-1979-0001832 | B | 12/1979 |
| KR | 10-2009-0132225 | A | 12/2009 |

OTHER PUBLICATIONS

International Search Report of PCT/KR2012/004017.

Office Action from Korean Intellectual Property Office for Korean Patent Application No. KR-10-2011-0072308.

Japanese Office Action dated Mar. 17, 2015 for Japanese Application No. 2014-510265.

Office Action for Chinese Application No. 201280025313.1 dated Jul. 2, 2015.

* cited by examiner

STORAGE TANK FOR LIQUIFIED MATERIALS AND SHIP COMPRISING SAME

CROSS-REFERENCE TO RELATED APPLICATIONS

This application is the national phase under 35 U.S.C. §371 of PCT International Application No. PCT/KR2012/004017, filed May 22, 2012, which claims priority to Korean Application No. 10-2011-0049372, filed May 25, 2011; Korean Application No. 10-2011-0072308, filed Jul. 21, 2011; and Korean Application No. 10-2011-0109620, filed Oct. 26, 2011, the entire contents of the aforementioned applications are hereby incorporated herein by reference.

TECHNICAL FIELD

The present invention relates to a liquid cargo storage tank and a ship including the same.

BACKGROUND

A liquefied gas carrier is used to carry liquefied gases such as liquefied natural gas (LNG) or liquefied petroleum gas (LPG) to consumption sites.

A liquefied gas carrier can be divided into an independent tank type and a membrane type depending on storage tank types. The independent tank type does not form an integral structure including a hull and a storage tank together, but has an independent storage tank which is supported by a supporting member of a hull. The independent tank type is divided into Type A, B, C according to a number of barriers to prevent leakage of liquefied gas and pressure. Type A includes aluminum double barrier tank (ADBT) provided by the AKER having both the first and the second barriers. Type B includes self-supporting, prismatic-shape IMO type B which is prismatic type provided by the IHI and a moss type with is spherical shape of the tank having the first barrier and a drip tray to prepare leaking of the first barrier. Type C includes the first barrier as a pressure container. On the other hand, the membrane type tank forms an integral structure including a hull and a storage tank together and is divided into a GTT Mark-III type and a GTT NO 96 type.

Particularly, the independent type tank can be installed to a ship after manufactured separately from the ship, have relatively better structural stability compared to the membrane type tank, and be facilitated to repair and maintain it since the insulation system is exposed to the outside of the tank.

On the other hand, when liquid cargo is transported with various storage tanks, events of leakages of liquid cargo to the outside of the storage tank can be caused due to a variety of reasons such as damages or cracks of the storage tank.

Since when such leakages are caused, it brings large economic losses. Therefore, a great deal of development research is currently under way on fundamentally preventing leakages or re-collecting the leaked liquid, etc.

The most general and widely used technology is installing drip trays at the lower part of the storage tank, and is described for example in KR Publication no 10-2010-0106741.

In this case, there is burden to install a large number of drip trays according to the storage tank structures and sometimes re-install when the position is not accurate. In case of much leakages, more drip trays should be installed, resulting in high cost.

Therefore, there is demand for overcoming such drawbacks described above.

DISCLOSE

Technical Problem

The present invention is to provide a liquid cargo storage tank to prevent leakage of liquid cargo safely and a ship including the same.

Technical Solution

According to an aspect of the present invention, there is provided a liquid cargo storage tank comprising: a body installed in a hull of a ship and having a liquid cargo receiving space by forming a space between the body and the hull; and a reinforcing plate installed in the lower part of the body in a state of being spaced apart from the underside of the body to be a floor of the liquid cargo receiving space.

The liquid cargo storage tank may further comprise an insulation member wrapping around the body in a state of being spaced apart from the body on the outside of the body, in which the space between the body and the insulation member may form a flow path to flow the liquid cargo leakage leaked to the outside of the body.

The liquid cargo storage tank may further comprise drip trays installed in the space to collect the liquid cargo leakage leaked to the space from the liquid cargo receiving space.

A leaked liquid collecting space may be formed between the underside of the body and the reinforcing plate to collect the liquid cargo leakage leaked from the liquid cargo receiving space to the space, and inflow holes may be formed on the lateral sides of the leaked liquid collecting space and connected to the liquid cargo receiving space to let the liquid cargo leakage leaked to the outside of the body inflow to the leaked liquid collecting space.

The liquid cargo storage tank may further comprise a check valve formed at the inflow hole to control flow of the leaked liquid cargo.

The liquid cargo storage tank may further comprise a sensor installed at the body to detect leakage of the liquid cargo, and a controlling part to open/close the check valve according to information from the sensor.

The liquid cargo storage tank may further comprise a blocking door installed at the inflow hole to control flow of the leaked liquid cargo and a driving part to open/close the blocking door.

The liquid cargo storage tank may further comprise a sensor installed at the body to detect leakage of the liquid cargo, and a controlling part to control the driving part to open/close the blocking door according to information from the sensor.

The liquid cargo storage tank may further comprise a shielding member installed at the inner side of the leaked liquid collecting space to shield the top and lateral sides of the inner side of the inflow hole.

The shielding member may further shield a part of the bottom part of the inner side of the inflow hole.

The liquid cargo storage tank may further comprise a guiding member installed at the outer side of the inflow hole to guide the leaked liquid cargo to the inflow holes.

The liquid cargo storage tank may further comprise a supporting member installed between the reinforcing plate and the underside part of the body to let the reinforcing plate and the underside part of the body support each other.

A leaked liquid collecting space may be formed between the underside of the body and the reinforcing plate to collect the liquid cargo leakage leaked from the liquid cargo receiving space, and inflow holes may be formed at the supporting member to let the collected liquid cargo leakage flow therethrough.

An oblique inclined part may be formed between the lateral side of the body and the underside part of the body.

According to another aspect of the present invention, there is provided a ship comprising a hull and the liquid cargo storage tank installed in the hull according to the present invention.

Advantageous Effects

According to an embodiment of the present invention, leakage of liquid cargo can be prevented more securely by reinforcing the lower area of a liquid cargo storage tank.

In addition, leakage of liquid cargo can be prevented more securely by storing the liquid cargo leakage at the space formed by reinforcing the lower area of a liquid cargo storage tank without installing an additional space and drip trays to store the liquid cargo leakage in the body.

| <Description of Reference Numberals> | |
|---|---|
| 1000, 2000: ship including a liquid cargo storage tank | |
| 100, 200: liquid cargo storage tank | |
| 1: hull | 2: inner surface of hull |
| 104: outer barrier | 107: inner barrier |
| 120: first barrier | 122: underside part |

-continued

| <Description of Reference Numberals> | |
|---|---|
| 124: wall part | 126: ceiling part |
| 128: inclined part | 130: second barrier |
| 140: drip tray | 150: inside space |
| 160: supporting member | 170: reinforcing member |
| 3000: ship including a liquid cargo storage tank | |
| 300, 301: liquid cargo storage tank | 3: gap |
| 10: first barrier | 20: second barrier |
| 302: inside space | 310: barrier |
| 312: underside part | 314: wall part |
| 316: ceiling part | 318: inclined part |
| 320: reinforcing barrier | 330: leaked liquid storage space |
| 332: leaked liquid inlet part | 340: guiding part |
| 350: check valve | 350a: blocking door |
| 350b: driving part | 352: sensor |
| 360; supporting member | 370: reinforcing member |
| 372: passage | 380: insulation member |
| 4000: liquid cargo storage tank | |
| 4100: body | 4102: lateral side |
| 4104: underside part | 4106: upper part |
| 4108: reinforcing member | 4110: inclined part |
| 4200: reinforcing plate | 4210: inlet hole |
| 4220: guiding member | 4230: shielding member |
| 4250: supporting member | 4252: inflow hole |
| 4300: insulation member | S1: liquid cargo receiving space |
| S2: leaked liquid collecting space | P: flow path |

MODE OF INVENTION

Embodiments of the invention will be described below in more detail with reference to the accompanying drawings, in which those components are rendered the same reference number that are the same or are in correspondence, regardless of the figure number, and redundant explanations are omitted.

The liquid cargo storage tank which will be described in embodiments of the present invention can be loaded in carriers, operating or positioning ships, or a variety of offshore structures.

Each embodiment of the present invention only describes a liquid cargo storage tank loaded on a carrier but it is not limited thereto since it can be applied to ships or offshore structures. The ship used herein includes a variety of ships and offshore structures.

Figure 1:
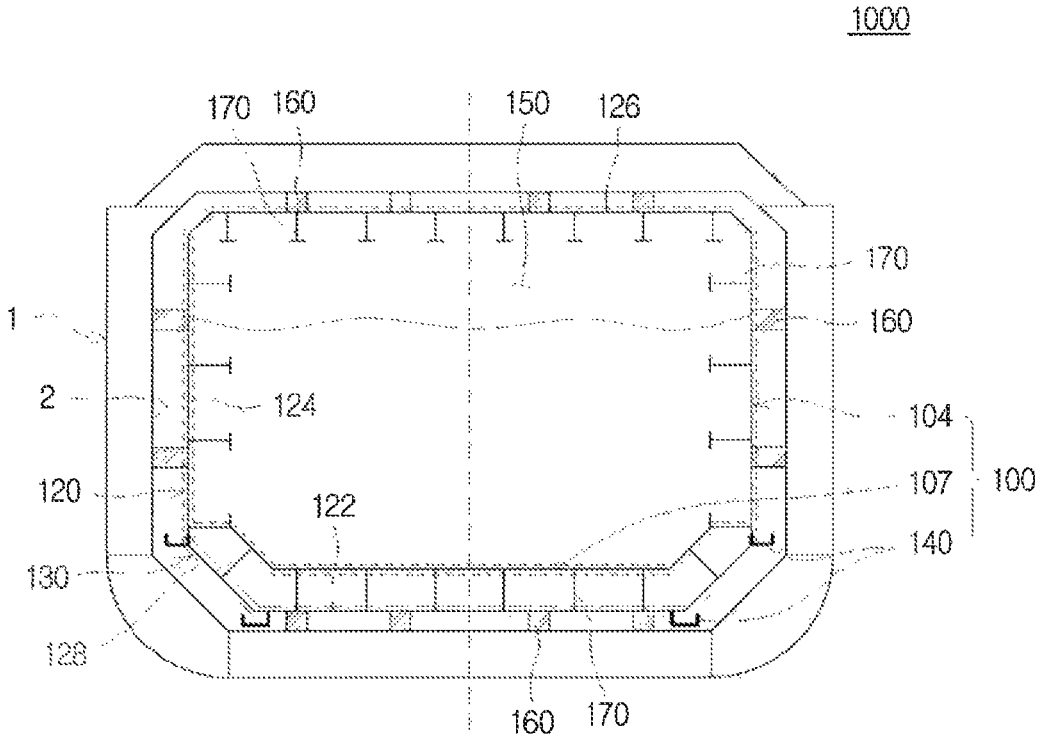
FIG. 1 is a sectional view of a ship including a liquid cargo storage tank according to the first embodiment of the present invention.

FIG. 1 is a schematic sectional view of a ship 1000 including a liquid cargo storage tank according to the first embodiment of the present invention.

Referring to FIG. 1, a ship 1000 including a liquid cargo storage tank of an embodiment of the present invention is a ship having a liquid cargo storage tank 100 which is arranged by being extended in a longitudinal direction of a hull 1. The ship comprises an outer barrier 104, an inner barrier 107, and a hull 1.

The hull 1 is designed as a double hull having an outer hull and an inner hull and a liquid cargo storage tank 100 can be loaded inside of the inner hull of the hull 1 to store liquefied gas.

As shown in FIG. 1, the liquid cargo storage tank 100 of an embodiment of the present invention is an independent type storage tank, comprises an outer barrier 104 and an inner barrier 107, and can be separately built and loaded in the hull 1.

In the liquid cargo storage tank 100 comprising the outer barrier 104 and the inner barrier 107, a barrier directly contacting with liquefied gas is generally called as a first barrier 120 (dotted lines in FIG. 1) and a barrier contacting with the liquefied gas leaked from the first barrier 120 is called as a second barrier 130 (point dashed lines in FIG. 1).

A ceiling part 126 and a wall part 124 of the outer barrier 104 form a ceiling part 126 and a wall part 124 of the first barrier 120, respectively. A bottom part 122 of the outer barrier 104 and a lower part of the wall part 124 form a bottom part 122 of the second barrier 130 and a lower part of the wall part 124, respectively.

The first barrier 120 formed by the outer barrier 104 and the inner barrier 107 is a barrier to maintain the air tightness of the liquid cargo storage tank 100 and an inside space 150 is formed to store liquefied gas in an air-tightened state inside the first barrier 120.

The outer barrier 104 and the inner barrier 107 are composed of metallic materials such as aluminum alloys, stainless steels, or Ni-9% steels in order to store very low temperature liquefied gas in an air-tightened state.

Even though it is not shown in FIG. 1, an insulation member such as polyurethane form may be attached on the surface of the outer barrier 104.

As shown in FIG. 1, the outer barrier 104 may be supported by supporting members 160 which are installed between the inner side 112 of the hull 1 and the outer barrier 104.

The outer barrier 104 is connected to the hull 1 by the supporting member 160 and liquefied gas is filled in the inside space 150 of the first barrier 120.

Reinforcing members can be installed at each of the wall part 124 and the ceiling part 126 of the first barrier 120 in an internal direction in order to withstand the weight of the cargo to be loaded in the inside space 150. Reinforcing members can be also installed between the bottom part 122 of the outer barrier 104 the lower part of the wall part 124, and the inner barrier 107. The reinforcing member 170 installed at the bottom part 122 of the outer barrier 104 can be connected to the lower part of the inner barrier 107 to support the inner barrier 107.

The inner barrier 107 in the liquid cargo storage tank 100 of an embodiment of the present invention is a barrier installed at the inner side of the bottom part 122 and the inner side of the wall part 124 to reinforce the bottom part 122 and the wall part 124 of the outer barrier 104 on which the weight is converged when liquefied gas is loaded.

In general, when cargo is loaded in the liquid cargo storage tank 100 and the inner barrier 107 is not installed, the greatest load is received to the bottom part 122 of the liquid cargo storage tank 100 and the lower part of the wall part 124. The load becomes less toward to the upper part of the liquid cargo storage tank 100. Liquefied gas exists only at the lower part of the liquid cargo storage tank 100 with decrease of amount of stored liquefied gas. Also, since the bottom part 122 is connected to the hull 1 by the supporting member 160 and the bottom part 122 supports the vertical weight of the liquid cargo storage tank 100, the weight is converged on the bottom part 122 rather than on the wall part 124 and the ceiling part 126. Thus, the liquefied gas is likely to leak at the lower part rather than at the upper part of the liquid cargo storage tank 100.

The inner barrier 107 is a barrier to reinforce the area where there is higher possibility for the liquefied gas to leak so that it can be selectively installed at the inner side of the bottom part 122 and the inner side of the wall part 124 to cover the bottom part 122 of the outer barrier 104 and the lower part of the wall part 124 as shown in FIG. 1.

In particular, the inner barrier 107 can be installed at a certain height from the lower end part to the upper part of the wall part 124 to cover the junction between the bottom part 122 and the wall part which is the edge part where cracks can be easily caused due to the stress when cargo is loaded.

In this case, the certain height can vary with design conditions when the liquid cargo storage tank 100 is built.

Accordingly, any leakage of the liquefied gas can be prevented by installing not only the outer barrier 104 but also the inner barrier 107 at the bottom part 122 of the outer barrier 104 and the lower part of the wall part 124.

Since the inner barrier 107 is selectively installed at the lower part, where the outer barrier 104 covers weakly, instead of installing inside the outer barrier 104 as a completely air-tightened container, total weight of the liquid cargo storage tank 100 can be reduced and reduction of the area of the inside space 150 where liquefied gas is stored can be minimized.

As shown in FIG. 1, the liquid cargo storage tank 100 of an embodiment of the present invention may further comprise drip trays 140.

The drip tray 140 is an equipment to receive and drain (discharge) the liquefied gas leaked from the outer barrier 104 when leakage is caused at the outer barrier 104.

The drip tray 140 is arranged between the inner side 112 of the hull 1 and the outer barrier 104 to receive the liquefied gas leaked from the outer barrier 104 of the liquid cargo storage tank 100.

The drip tray 140 can be installed at the edge which is the junction between the bottom part 122 of the outer barrier 104 and the wall part 124. The drip tray 140 can be also installed at the outer side of the bottom part 122 of the outer barrier 104.

As shown in FIG. 1, an inclined part 128 can be formed at the edge part which is the junction between the bottom part 122 and the wall part 124 of the outer barrier 104. In this case, the inner barrier 107 can be installed to cover the inclined part 128.

The drip tray 140 can be installed at at least one of the outer side of the bottom part 122 of the outer barrier 104 and the outer side of the inclined part 128.

Particularly, the drip tray 140 can be installed at each of the upper end part and the lower end part of the inclined part 128 as shown in FIG. 1.

That is, the drip tray 140 can be installed at the outer side of the upper end part of the inclined part 128 which is the junction with the wall part 124 and also at the outer side of the lower end part of the inclined part 128 which is the junction with the bottom part 122.

Figure 2:
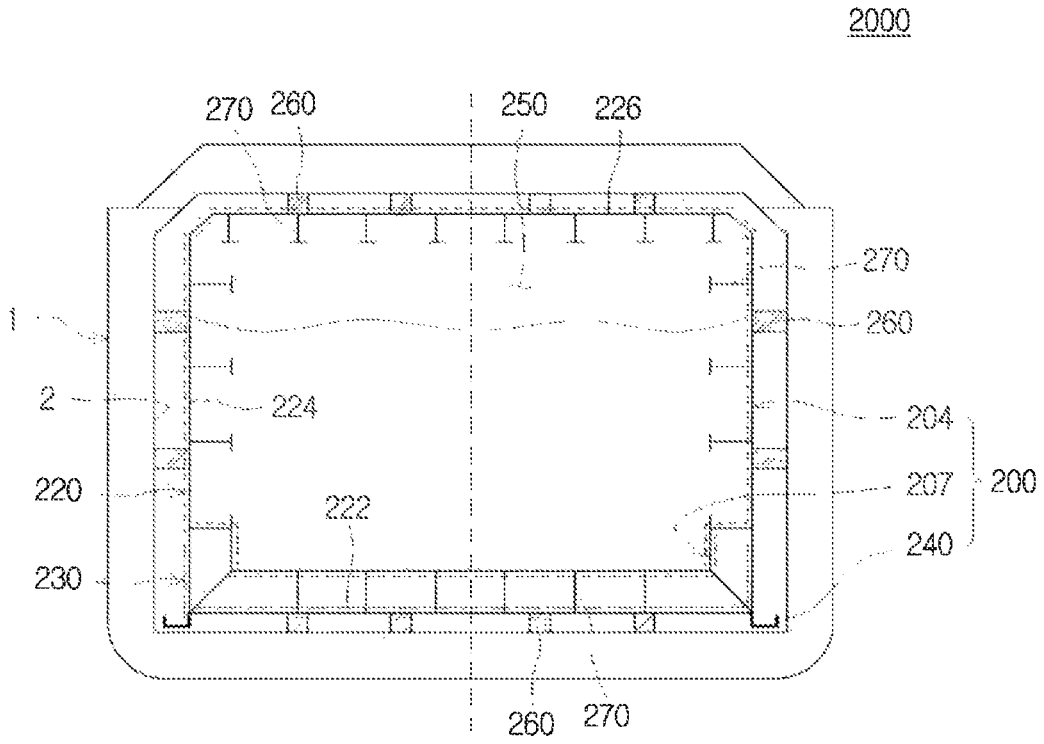
FIG. 2 is a sectional view of a ship including a liquid cargo storage tank according to the second embodiment of the present invention.

FIG. 2 is a sectional view of a ship 2000 including a liquid cargo storage tank according to the second embodiment of the present invention.

Referring to FIG. 2, a ship 2000 including a liquid cargo storage tank of an embodiment of the present invention is a ship having a liquid cargo storage tank 200 which is arranged by being extended in a longitudinal direction of a hull 1. The ship comprises an outer barrier 204, an inner barrier 207, and a hull 1.

The liquid cargo storage tank 200 of an embodiment of the present invention has the same or similar configuration and functions to the liquid cargo storage tank 100 described in the above embodiment and thus the overlapped description will be omitted.

Particularly, since the configurations and functions of inner surface 212 of the hull 1, a first barrier 220 (dotted lines in FIG. 2), an underside part 222, a wall part 224, a ceiling part 226, a second barrier 230 (point dashed lines in FIG. 2), a drip tray 240, an inside space 250, a supporting member 260, and a reinforcing member 270 are the same with or similar to the one described in the above embodiment, the overlapped description will be omitted.

In this embodiment, the difference from the above described embodiment is that the underside part 222 of an outer barrier 204 and the wall part 224 meet each other perpendicularly.

Here, drip trays 240 can be installed at the outer side of the edge part which is the junction between the underside part 222 of the outer barrier 204 and the wall part 224.

According to this embodiment of the present invention, an inner barrier 207 can be installed at the underside part 222 of the outer barrier 204 and the lower part of the wall part 224 in addition to the outer barrier 204 in order to prevent leakage of the liquefied gas more safely and improve the weight of the liquid cargo storage tank 200 and the cargo receiving area of the inside space 250.

Figure 3:
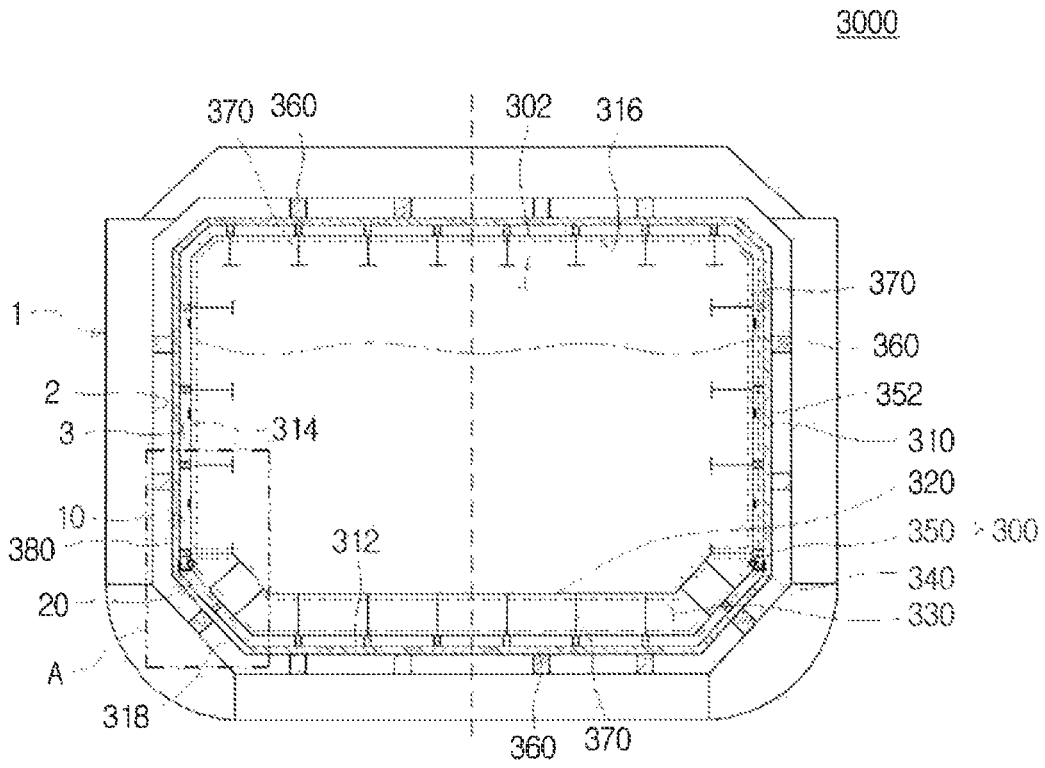
FIG. 3 is a sectional view of a ship including a liquid cargo storage tank according to the third embodiment of the present invention.
Figure 4:
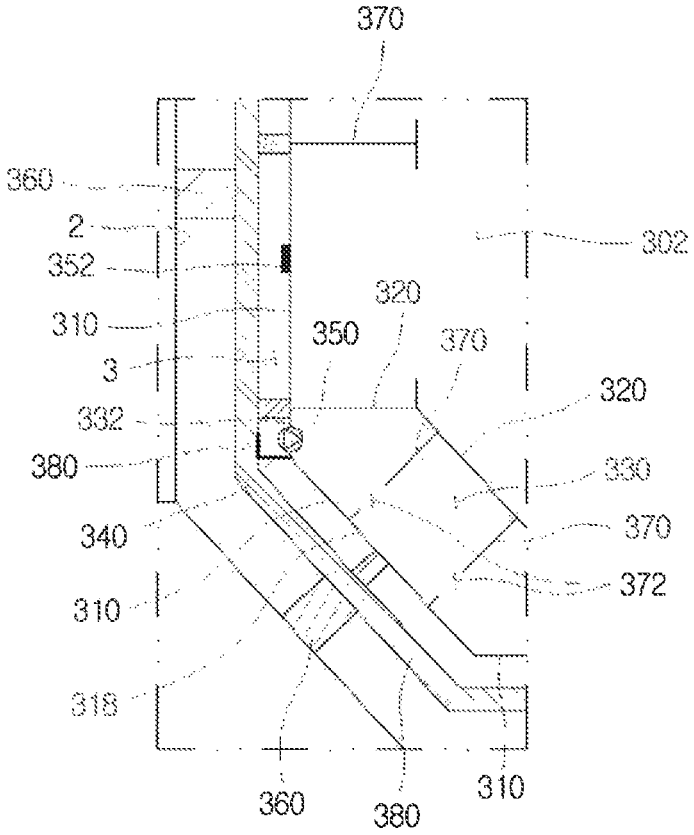
FIG. 4 is an enlarged view of A part in FIG. 3.

FIG. 3 is a schematic sectional view of a ship 3000 including a liquid cargo storage tank according to the third embodiment of the present invention. FIG. 4 is an enlarged view of A part in FIG. 3.

Referring to FIG. 3, a ship 3000 including a liquid cargo storage tank of an embodiment of the present invention is a ship having a liquid cargo storage tank 300 which is arranged by being extended in a longitudinal direction of a hull 1. The ship comprises a hull 1, a barrier 310, a reinforcing barrier 320 and a leaked liquid storage space 330.

The hull 1 is designed as a double hull having an outer hull and an inner hull and a liquid cargo storage tank 300 can be loaded inside of the inner hull of the hull 1 to store liquefied gas.

As shown in FIG. 3, the liquid cargo storage tank 300 of an embodiment of the present invention is an independent type storage tank, comprises the barrier 310, the reinforcing barrier 320 and the leaked liquid storage space 330, and can be separately built and loaded in the hull 1.

According to an embodiment of the present invention, a storage space, particularly the leaked liquid storage space 330, is formed between the barrier 310 forming the appearance of the liquid cargo storage tank 300 and the reinforcing barrier 320 reinforcing the lower part of the barrier 310 so that the liquefied gas leakage leaked from the ceiling part 316 of the barrier 310, the wall part 314 and the reinforcing barrier 320 can be stored temporally therein even during the emergency of the leakage of the liquefied gas.

According to an embodiment of the present invention, it is not necessary to install an additional space to store the leaked liquefied gas or drip trays to receive the leaked liquefied gas which should be installed in the conventional liquefied gas storage tank.

Hereinafter, each configuration of the liquid cargo storage tank 300 of an embodiment of the present invention will be explained in more detail with reference to the accompanying FIG. 3 and FIG. 4.

The barrier 310 is installed in a state of being spaced apart on the inner surface 2 of the hull 1 of the ship 3000 as an air-tightened container to store liquefied gas.

As shown in FIG. 4, a gap 3 is formed between the barrier 310 and the inner surface 2 of the hull through which the liquefied gas leakage leaked from the ceiling part 316 and the wall part 314 of the barrier 310 among the liquefied gas leakage leaked from the barrier 310 flows into the leaked liquid storage space 330.

The reinforcing barrier 320 is an additional barrier to reinforce the area which is the part likely to leak the liquefied gas and is installed on the lower part of the barrier 310.

Here, the lower part of the barrier 310 includes the underside part 312 and the wall part 314 of the barrier 310.

In the liquid cargo storage tank 300 comprising the barrier 310 and the reinforcing barrier 320, a barrier directly contacting with liquefied gas is generally called as a first barrier 10 (dotted lines in FIG. 3) and a barrier contacting with the liquefied gas leaked from the first barrier 10 is called as a second barrier 20 (point dashed lines in FIG. 3).

As shown in FIG. 3, the ceiling part 316 and the wall part 314 of the barrier 310 form a ceiling part and a wall part of the first barrier 10, respectively. The underside part 312 of the barrier 310 and the lower part of the wall part 314 form a bottom part of the second barrier 20 and a lower part of the wall part 314, respectively.

The first barrier 10 formed by the barrier 310 and the reinforcing barrier 320 is a barrier to maintain the air tightness of the liquid cargo storage tank 300 and an inside space 302 is formed to store liquefied gas in an air-tightened state inside the first barrier 10.

The barrier 310 and the reinforcing barrier 320 are composed of metallic materials such as aluminum alloys, stainless steels, or Ni-9% steels in order to store very low temperature liquefied gas in an air-tightened state.

The reinforcing barrier 320 in the liquid cargo storage tank 300 of an embodiment of the present invention is a barrier installed at the inner side of the underside part 312 and the inner side of the wall part 314 to reinforce the lower part of the barrier 310, particularly the underside part 312 and the wall part 314, on which the weight is converged when liquefied gas is loaded.

In general, when cargo is loaded in the liquid cargo storage tank 300 and the reinforcing barrier 320 is not installed, the greatest load is received to the underside part 312 and the wall part 314 of the barrier 310. The load becomes less toward to the upper part of the liquid cargo storage tank 300. Liquefied gas exists only at the lower part of the liquid cargo storage tank 300 with decrease of storage amount of liquefied gas. Thus, the liquefied gas is likely to leak at the lower part rather than at the upper part of the barrier 310.

Thus, the reinforcing barrier 320 can be selectively installed at the inner side of the underside part 312 and the inner side of the wall part 314 to cover the underside part 312 of the barrier 310 and the lower part of the wall part 314 as shown in FIG. 3.

In particular, the reinforcing barrier 320 can be installed at a certain height from the lower end part to the upper part of the wall part 314 to cover the junction between the underside part 312 and the wall part 314 which is the edge part where cracks can be easily caused due to the stress when cargo is loaded.

In this case, the certain height can vary with design conditions when the liquid cargo storage tank 300 is built.

Accordingly, any leakage of the liquefied gas can be prevented by installing not only the reinforcing barrier 320 but also the barrier 310 at the bottom part of the barrier 310 and the lower part of the wall part 314.

Since the reinforcing barrier 320 is selectively installed at the lower part, where the barrier 310 covers weakly, total weight of the liquid cargo storage tank 300 can be reduced and reduction of the area of the inside space 302 where liquefied gas is stored can be minimized.

As shown in FIG. 3 and FIG. 4, an inclined part 318 can be formed at the edge part which is the junction between the underside part 312 and the wall part 314 of the barrier 310. In this case, the reinforcing barrier 320 can be installed to cover the inclined part 318.

The leaked liquid storage space 330 is a space formed between the barrier 310 and the reinforcing barrier 320 as shown in FIG. 3 to store temporally the liquefied gas leakage leaked through damaged portions of the first barrier 10 while the ship 3000 moves to a port to repair cracks or damages caused to the first barrier 10.

In addition, the leaked liquid storage space 330 has greater capacity compared to conventional drip trays so that it stores the leaked liquefied gas more safely even though amount of the leaked liquefied gas is much or the ship 3000 takes a long period of time to a port.

That is, the leaked liquid storage space 330 formed between the barrier 310 and the reinforcing barrier 320 can store the leaked liquid temporally on behalf of the conventional drip trays so that it is not necessary to install separate drip trays.

For this purpose, a leaked liquid inlet part 332 can be formed at the upper side of the leaked liquid storage space 330 to collect the liquefied gas leakage leaked from the ceiling part 316 and the wall part 314 of the barrier 310.

A guiding part 340 can be installed between the inner surface 2 of hull and barrier 310 to collect and guide liquefied gas leakage flowing along the surface of the outer side of the barrier 310 to the leaked liquid inlet part 332.

The guiding part 340 can be installed adjacent to the leaked liquid inlet part 332 and fixed and combined to the upper end part of the outer side of the leaked liquid storage space 330 to be protruded toward the inner surface 2 of the hull from the outer side of the leaked liquid storage space 330.

In addition, when the liquid cargo storage tank 300 is made of aluminum, the guiding part 340 can be manufactured integrally with the barrier 310 through extrusion.

A cross-sectional shape of the guiding part 340 can be L-shape or flat shape. The guiding part 340 can be combined at the outer side of the area which is the junction between the barrier 310 and the reinforcing barrier 320. Particularly, the guiding part 340 can be combined at the outer side of the boundary area which is the junction between the barrier 310 and the leaked liquid storage space 330.

The liquid cargo storage tank 300 of an embodiment of the present invention may further comprise a check valve 350 installed at the leaked liquid inlet part 332 to control the flow of the leaked liquefied gas which passes the leaked liquid inlet part 332.

When the liquefied gas stored in the inside space 302 leaks and flows into the leaked liquid storage space 330 due to cracks caused in the ceiling part 316 and the wall part 314 of the first barrier 10, particularly the ceiling part 316 and the wall part 314 of the of the barrier 310, or the liquefied gas stored in the inside space 302 leaks and flows into the space between the reinforcing barrier 320 and the barrier 310, particularly into the leaked liquid storage space 330, the check valve 350 allows the leaked liquefied gas in the leaked liquid storage space 330 flowing in only one direction and blocks the flow into the opposite direction in order to prevent flowing to the gap 3 between the inner surface 2 of the hull and the barrier 310 through the leaked liquid inlet part 332.

In this embodiment, the check valve 350 can be a solenoid valve. The leaked liquid inlet part 332 can be controlled by an electric current through a solenoid.

Here, the liquid cargo storage tank 300 of the present invention may further comprise a controlling part (not shown) to control the operation of the check valve 350 which can be a solenoid valve.

Figure 5:
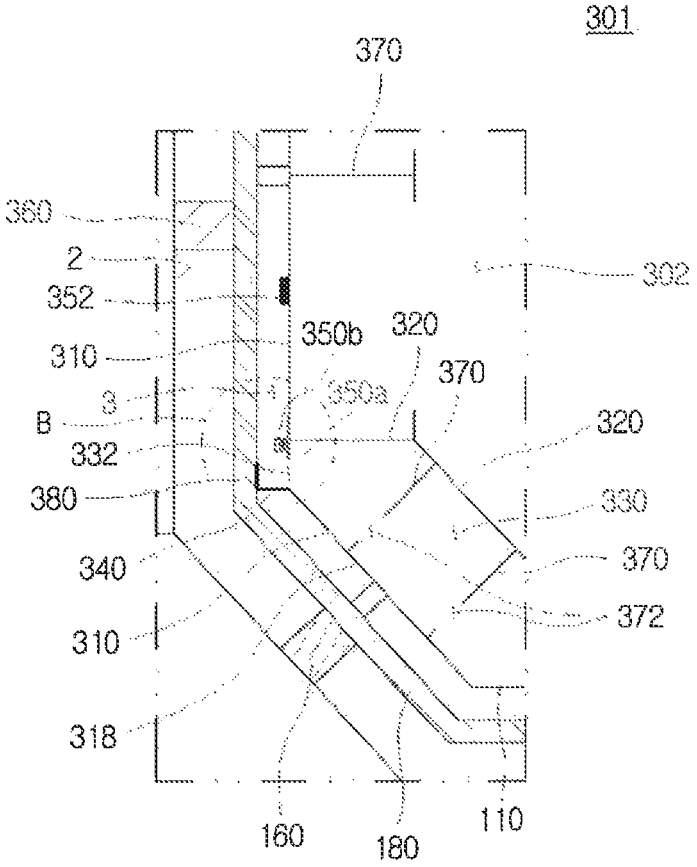
FIG. 5 is a modified view of a liquid cargo storage tank according to the third embodiment of the present invention.
Figure 6:
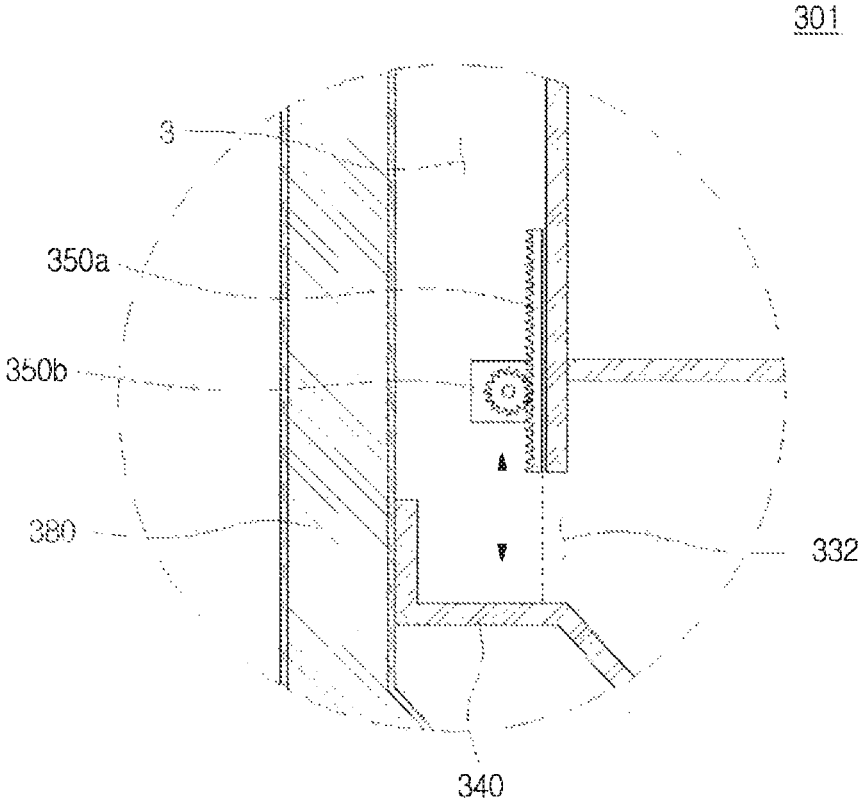
FIG. 6 is enlarged view of B part in FIG. 5.

FIG. 5 is a view illustrating a liquid cargo storage tank 300 according to the third embodiment of the present invention. FIG. 6 is enlarged view of B part in FIG. 5.

As another example in addition to the liquid cargo storage tank 300 of the above embodiment, a blocking door 350*a* can be installed at the leaked liquid inlet part 332 to control the flow of the leaked liquefied gas passing through the leaked liquid inlet part 332 as shown in FIG. 5 and FIG. 6. Here, the liquid cargo storage tank 300 of an embodiment of the present invention may further comprise a driving part 350*b* to open/close the blocking door 350*a* and a controlling part (not shown) to control the driving part 350*b*.

Particularly, the blocking door 350*a* can be installed on the outer side of the barrier 310 adjacent to the leaked liquid inlet part 332 to be slidable to open/close the leaked liquid inlet part 332 by welding or bolt screwing as shown in FIG. 6.

Here, rack can be formed along to the surface of one side of the blocking door 350*a* and pinion gear enable to be engaged in the rack can be installed on the driving part 350*b* which is installed adjacent to the blocking door 350*a*.

The driving part 350*b* may comprise a motor to rotate the pinion gear and be driven according to control signals inputted from the controlling part (not shown) by being electrically connected with the controlling part.

Thus, the blocking door 350*a* can open/close the leaked liquid inlet part 332 by the driving part 350*b* rotating the pinion gear according to signals of the controlling part (not shown).

A sensor may be installed on the barrier 310 to detect leakage of the liquefied gas when the liquefied gas stored inside the barrier 310 leaks to outside of the barrier 310. Here, more than one sensor 352 can be installed on the outer side of the barrier 310.

When the sensor 352 installed on the barrier 310 detects any leakage of the liquefied gas, the sensor 352 sends a signal informing the leakage to the controlling part (not shown) which then opens/closes the check valve 350 or the blocking door 350*a* according to the information of the sensor 352.

As shown above in FIG. 3, the embodiment has described the sensor 352 installed on the first barrier 10. However, the sensor 352 can be installed on the second barrier 20 or the barrier 310 and further it is not limited thereto.

As shown in FIG. 4, an insulation member 380 can be installed on the outer side of the liquid cargo storage tank 300 comprising the barrier 310 and the reinforcing barrier 320 to block heat transfer between the inside and the outside of the liquid cargo storage tank 300.

The insulation member 380 can be composed of, for example, polyurethane form or the like and made of, for example, a plurality of assembly type insulation panels. Here, the plurality of insulation panels can be interconnected with cushion joints (not shown) or can be attached on the surface of the barrier 310 by fastening members such as stud.

In this embodiment, the outer side of the barrier 310 and the insulation member 380 are formed to be spaced apart to allow the liquefied gas leakage leaked from the barrier 310 flowing down. That is, the gap 3 is formed between the barrier 310 and the inner surface 2 of the hull.

As shown above in FIG. 3, the barrier 310 can be supported by a supporting member 360 installed between the inner surface 2 of the hull and the barrier 310.

The barrier 310 is supported to the hull 1 by the supporting member 360 and liquefied gas is filled to the inside space 302 of the first barrier 10.

Further, reinforcing members 370 can be installed at each of the wall part 314 and the ceiling part 316 of the first barrier 10 in an internal direction of the first barrier 10 in order to withstand the weight of the liquefied cargo to be loaded.

Reinforcing members can be also installed between the bottom part 312 of the barrier 310, the lower part of the wall part 314 and the reinforcing barrier 320. Here, the reinforcing member 370 installed at the bottom part 312 of the barrier 310 can be connected to the reinforcing barrier 320 to support the reinforcing barrier 320.

The reinforcing member 370 is installed between the barrier 310 and the reinforcing barrier 320 to connect the barrier 310 and the reinforcing barrier 320 and thus allow the barrier 310 and the reinforcing barrier 320 supporting each other.

Here, passages 372 can be formed to prevent the leaked liquid storage space 330, formed between the barrier 310 and the reinforcing barrier 320, from being divided into several compartments due to the reinforcing member 370 by allowing the leaked liquefied gas collected in the leaked liquid storage space to pass through the reinforcing member 370. FIG. 4 illustrates a sectional view of the passage 372 of the reinforcing member 370. Here, the passage 372 can be a hole formed on the reinforcing member 370.

When cracks are caused in the lower end part of the first barrier 10, particularly the reinforcing barrier 320, the liquefied gas leaked through the cracks can be collected directly to the leaked liquid storage space 330.

It has been described that the liquid cargo storage tank 300 of an embodiment of the present invention includes the inclined part 318 at the edge part of the barrier 310 but it is not limited thereto since it also includes the case that there is no inclined part 318 at the edge part of the barrier 310 of the liquid cargo storage tank 300.

The reinforcing barrier 320 can be installed at a certain height from the lower end part to the upper part of the wall part 314 to cover the junction between the underside part 312 and the wall part 314 which is the edge part where cracks can be easily caused due to the stress when cargo is loaded.

In this case, the certain height can vary with design conditions when the liquid cargo storage tank 300 is built Here, the guiding part 340 can be installed on the outer side of the junction between the barrier 310 and the reinforcing barrier 320 to be arranged between the inner surface 2 of the hull and the barrier 310.

The reinforcing barrier 320, installed at underside part of the barrier 310, particularly the lower part of the wall part 314 and the underside part 312, in addition to the barrier 310 prevents leakage of the liquefied gas more safely.

Since the reinforcing barrier 320 is selectively installed at the lower part, where the barrier 310 covers weakly, total weight of the liquid cargo storage tank 300 can be reduced and reduction of the area of the inside space 302 where liquefied gas is stored can be minimized.

According to this embodiment of the present invention, the reinforcing barrier is installed at the lower part of the barrier in addition to the barrier in order to prevent leakage of the liquefied gas more safely and improve the weight of the liquid cargo storage tank and the cargo receiving area of the inside space.

Further, it is not necessary to install a space to store the leaked liquefied gas or a drip tray to receive the leaked liquefied gas since the leaked liquefied gas can be stored in the space formed at the lower part of the liquid cargo storage tank.

Figure 7:
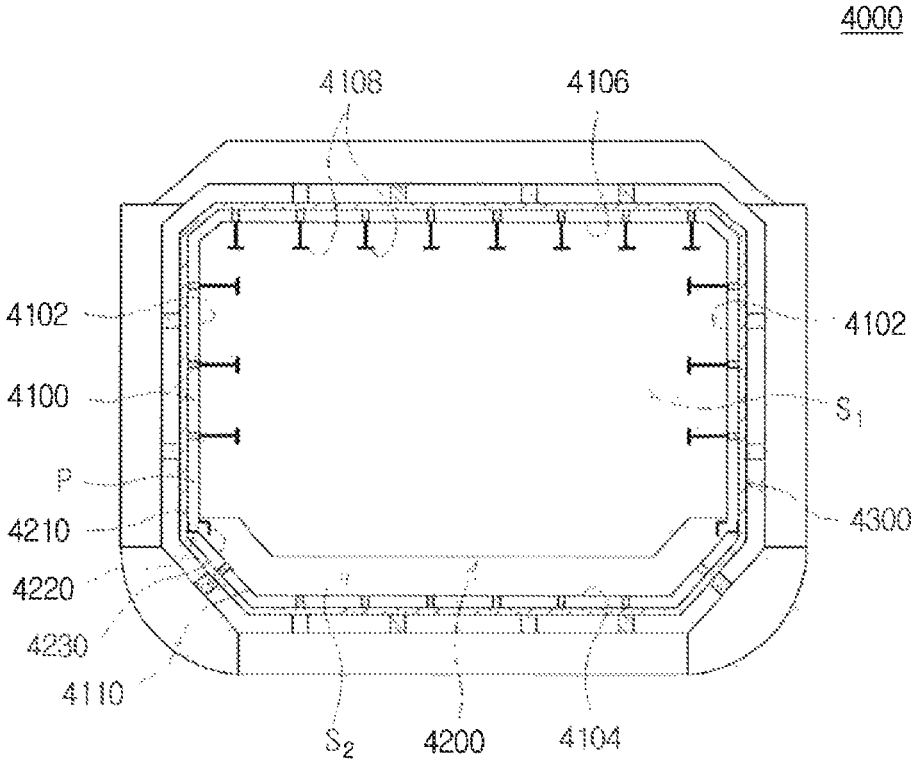
FIG. 7 is a sectional view of a liquid cargo storage tank installed in a hull according to the fourth embodiment of the present invention.

FIG. 7 is a sectional view of a liquid cargo storage tank 4000 installed in a hull according to the fourth embodiment of the present invention. As shown in FIG. 7, the liquid cargo storage tank 4000 according to an embodiment of the present invention includes a body 4100 reinforcing plate 4200.

A liquid cargo receiving space S1 is formed inside the body 4100 to receive liquid cargo. The body 4100 of an embodiment of the present invention includes a lateral side 4102, an underside part 4104, a upper part 4106. Also reinforcing members 4108 are installed on the lateral side 4102 and the upper part 4106 in an internal direction of the body 4100 in order to withstand the weight of the liquid cargo to be loaded. A space is formed between the body 4100 and the hull 1.

A reinforcing plate 4200 is installed at the lower part of the inner side of the body 4100 by being spaced apart from the underside part 4104 of the body. Thus, the reinforcing plate 4200 secures a part of the lower part of the liquid cargo receiving space S1, which particularly forms the floor of the liquid cargo receiving space S1.

The part of the lower part of the liquid cargo receiving space S1 is allocated as a leaked liquid collecting space S2 to collect the liquid cargo leakage leaked from the liquid cargo receiving space S1.

In general, when liquid cargo is loaded in the liquid cargo storage tank, the greatest load is received to the underside part 4104 of the body 4100. The load becomes less toward to the upper part of the lateral side 4102 of the body 4100. Thus, the liquefied gas is likely to leak at the lower part rather than at the upper part of the body 4100 so that the reinforcing plate 4200 is installed at the lower part of the inner side of the body 4100.

Even though the reinforcing plate 4200 can be installed on the lateral side 4102, in this embodiment the reinforcing plate 4200 is installed only on the lower part of the body 4100 since it can reduce the loading capacity by reducing the liquid cargo receiving space S1.

A size of the leaked liquid collecting space S2 can be controlled in accordance with the height of the reinforcing plate 4200.

An inflow hole 4210 can be formed at the lateral side of the leaked liquid collecting space S2 formed by the reinforcing plate 4200. This allows the leaked liquid flowing down on the lateral side of the body 4100 to the leaked liquid collecting space S2 when the leakage is caused from the lateral side of the body 4100.

The leakage leaked from the floor of the liquid cargo receiving space S1 can be collected directly to the leaked liquid collecting space S2 and the leakage leaked from the lateral side 4102 of the body 4100 can be also collected to the leaked liquid collecting space S2 through the inflow hole 4210.

According to an embodiment of the present invention, all leaked liquid can be collected to and stored temporally in the leaked liquid collecting space S2 even though leakage is caused from the body 4100 of the storage tank.

In an embodiment of the present invention, an insulation member 4300 wrapping around the body 4100 in a state of being spaced apart from the body 4100 can be arranged. The insulation member 4300 is arranged to insulate the body 4100 and be supported by a plurality of supporting structures as well as the hull 1 and the body 4100. A space between the body 4100 and the insulation member 4300 is formed by the insulation member 4300 in this embodiment so that any leaked liquid can leak to this space. In case that the insulation member 4300 is not installed, it is apparent that the body 4100 be supported directly to the hull 1 in a state of being spaced apart.

A flow path P, through which the leakage leaked from the lateral side 4102 of the body 4100 flows, can be formed at the space formed between the insulation member 4300 and the body 4100. Even though high-pressured leakage flux is caused due to cracks on the lateral side 4102 of the body 4100, any leakage may not be lost by the insulation member 4300 and be collected through the flow path P.

This embodiment will be explained in more detail with reference to the accompanying FIG. 8 which illustrates an enlarged sectional view of the edge where inflow holes 4210 are formed.

Figure 8:
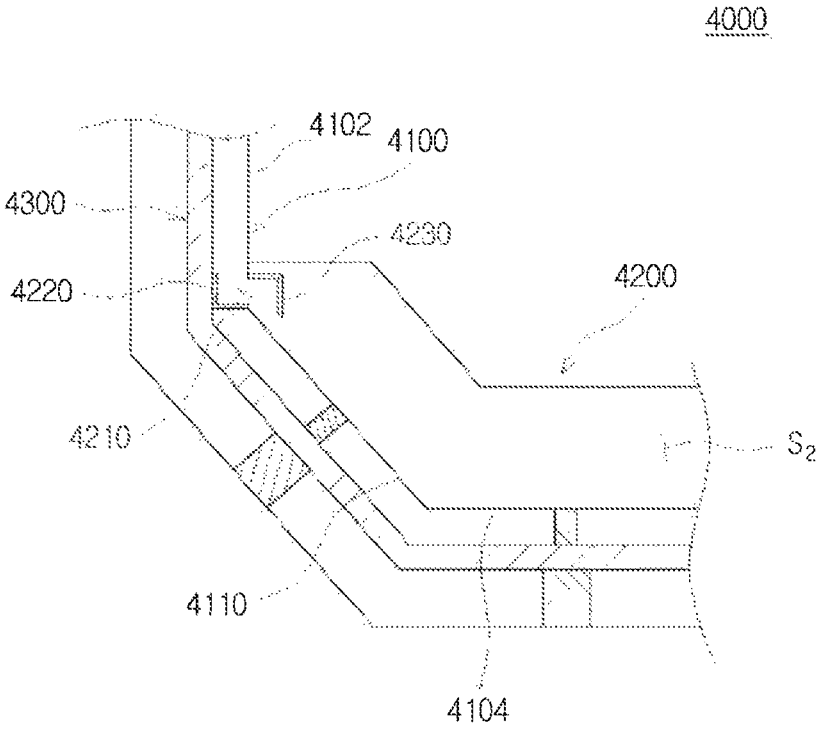
FIG. 8 is an enlarged sectional view of the edge where an inflow hole is formed, in a liquid cargo storage tank according to the fourth embodiment of the present invention.

Referring to FIG. 8, it is noted that the inflow hole 4210 is formed on the lateral side of the leaked liquid collecting space S2 to allow the leakage flowing down on the lateral side 4102 of the body 4100 to flow into the leaked liquid collecting space S2.

Here, a guiding member 4220 can be further installed on the outer side of the inflow hole 4210 in order to facilitate the flow of the leaked liquid. The guiding member 4220 is arranged between the body 4100 and the insulation member 4300 to guide the leakage into the inflow hole 4210 through the flow path P.

For this purpose, the guiding member 4220 of this embodiment is formed in an L-shape and fixed at the each side of the insulation member 4300 and the body 4100. However, it is not limited thereto since the shape and the position can be formed in various ways. For example, the floor surface of the guiding member 4220 can be inclined to guide the leaked liquid faster and more safely.

An oblique inclined part 4110 is formed between the lateral side 4102 and the underside part 4104 of the body 4100. The inclined part 4110 is usually installed to distribute the load converged at the edge when liquid cargo is loaded in the body 4100. In this case, as illustrated in FIG. 8, the reinforcing plate 4200 can be also formed corresponding to the shape of the inclined part 4110.

Here, the inflow hole 4210 is formed at the point where the lateral side 4102 of the body 4100 and the inclined part 4110 meet since when the inflow hole 4210 is formed in the midpoint of the inclined part 4110, it may be difficult to guide the leakage into the inflow hole 4210.

The reinforcing plate 4200 is also formed to correspond to the inclined part 4110 so that the both sides can be inclined.

This structure allows smooth collecting of the leaked liquid to the leaked liquid collecting space S2, but it may cause backward flowing of the leaked liquid to the outer side of the leaked liquid collecting space S2 through the inflow hole 4210.

Thus, a shielding member 4230 may be installed to prevent such a problem of backward flowing in this embodiment. The shielding member 4230 is formed on the inner side of the inflow hole 4210, particularly to block the upper part and the lateral side of the inner side of the inflow hole 4210.

Backward flowing of the leaked liquid can be minimized with the installation of the shielding member 4230 and even the inflow hole 4210 can be protected when the leaked liquid flows in a high pressure due to cracks caused on the reinforcing plate 4200.

In an embodiment of the present invention, the shielding member 4230 having an upside downed "L" shape is formed on the lateral side 4102 of the body 4100. Here, it prevents the backward flowing of the leaked liquid more efficiently when the lateral side of the shielding member 4230 is formed as long as possible.

Accordingly, the inflow hole 4210 and the guiding member 4220 of the present invention allow collecting the all leakage leaked to the outer side of the body 4100 to the leaked liquid collecting space S2 and the shielding member 4230 prevents the leaked liquid collected in the shielding member 4230 from backward flowing. Hereinafter, other embodiments of the present invention will be described.

Figure 9:
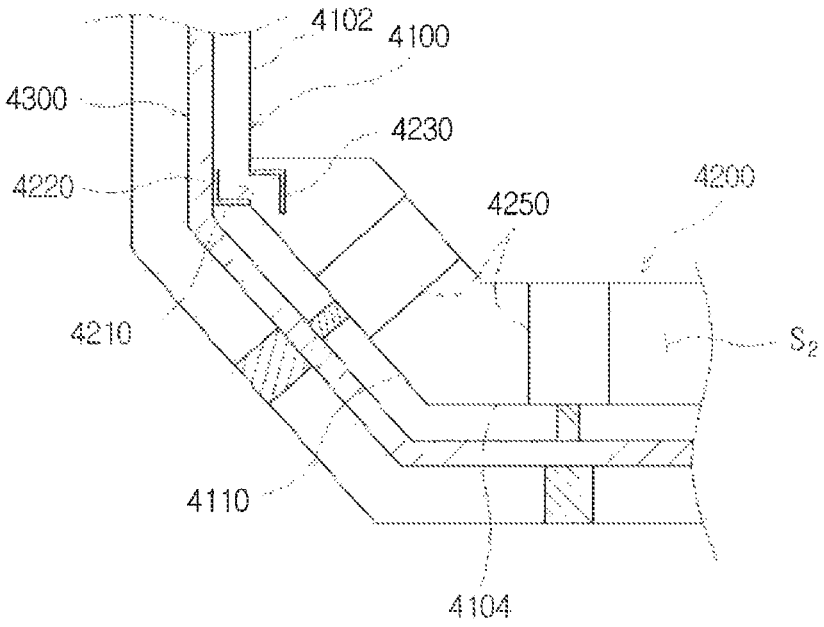
FIG. 9 is an enlarged sectional view of the edge where an inflow hole is formed, in a modified liquid cargo storage tank according to the fourth embodiment of the present invention.

FIG. 9 is an enlarged sectional view of the edge, where inflow holes 4210 are formed, in a modified liquid cargo storage tank according to the fourth embodiment of the present invention. As shown in FIG. 9, all elements of this embodiment are identical to those in the fourth embodiment, except supporting members 4250 formed between the reinforcing plate 4200 and the underside part 4104 of the body 4100, and the inclined part 4110. Thus, the description on the other elements will be omitted, except the supporting members 4250.

It provides a strong structure to the load of the liquid cargo by supporting the reinforcing plate 4200 through the supporting member 4250. A plurality of supporting members 4250 can be installed between the reinforcing plate 4200 and the underside part 4104 of the body 4100, and the inclined part 4110 in horizontal and vertical directions. Thus, the leaked liquid flowed into the leaked liquid collecting space S2 can flow between the plurality of supporting members 4250.

The body 4100, the reinforcing plate 4200, the guiding member 4220, the shielding member 4230 and the supporting member 4250 can be made of materials, for example, metallic materials such as aluminum alloys, stainless steels, Ni-9% steels which are able to store very low temperature liquid cargo in an air-tightened state.

Figure 10:
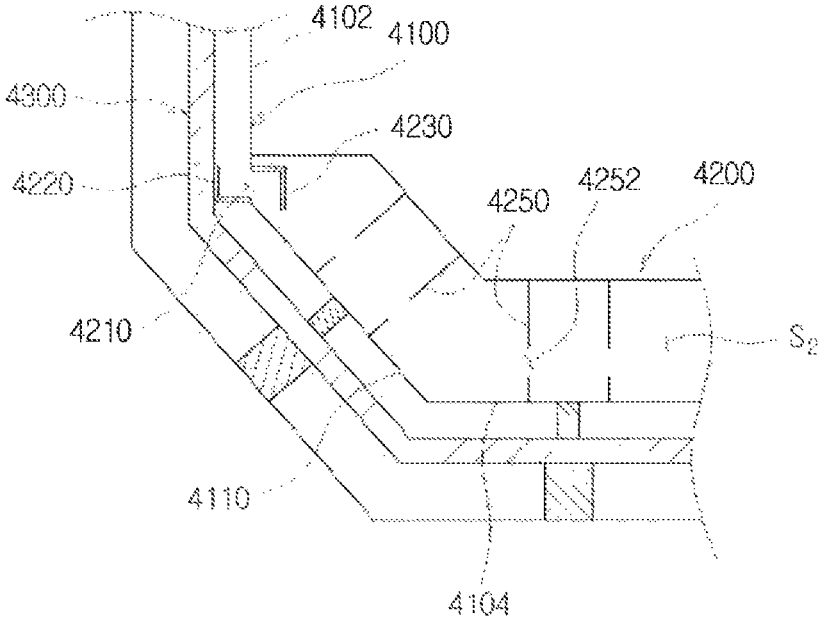
FIG. 10 is an enlarged sectional view of the edge where an inflow hole is formed, in another modified liquid cargo storage tank according to the fourth embodiment of the present invention.

FIG. 10 is an enlarged sectional view of the edge, where inflow holes 4210 are formed, in another modified liquid cargo storage tank according to the fourth embodiment of the present invention.

In this embodiment, the liquid cargo storage tank further includes inflow holes 4252 in the supporting member 4250 of the fourth embodiment of the present invention.

Here, since the leaked liquid flowed into the supporting member 4250 may flow through the inflow holes 4252, it is possible that the supporting member 4250 be formed as long as the total length of the liquid cargo storage tank so that it can be stronger than the load.

Figure 11:
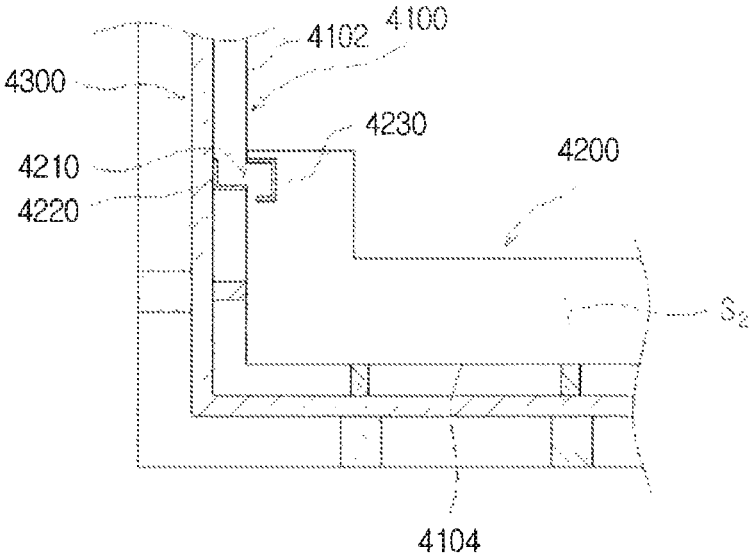
FIG. 11 is an enlarged sectional view of the edge where an inflow hole is formed, in still another modified liquid cargo storage tank according to the fourth embodiment of the present invention.

FIG. 11 is an enlarged sectional view of the edge, where inflow holes 4210 are formed, in still another modified liquid cargo storage tank according to the fourth embodiment of the present invention. Unlike the other embodiments described above, the body 4100 does not include the inclined part so that the lateral side 4102 and the underside part 4104 are directly connected at right angle.

Here, since the lower part of the inner side of the inflow hole 4210 can be opened widely, the shielding member 4230 may be formed to further block a part of the lower part of the inflow hole 4210 in addition to the upper part and the lateral part of the inner side of the inflow hole 4210 to provide identical or similar effect which is provided in the other embodiment described above. In this case, the shape of the shielding member 4230 is not limited to the embodiment shown in FIG. 11 and can be formed in various ways.

In addition, the supporting member 4250 (not shown) and the inflow hole 4252 (not shown) can be installed in the embodiment in FIG. 11 as installed in the FIG. 10 and FIG. 10.

In this embodiment, the reinforcing plate 4200 can be formed to be bent corresponding to the shape of the body 4100, but it is not limited thereto since it can be a flat shape.

Figure 12:
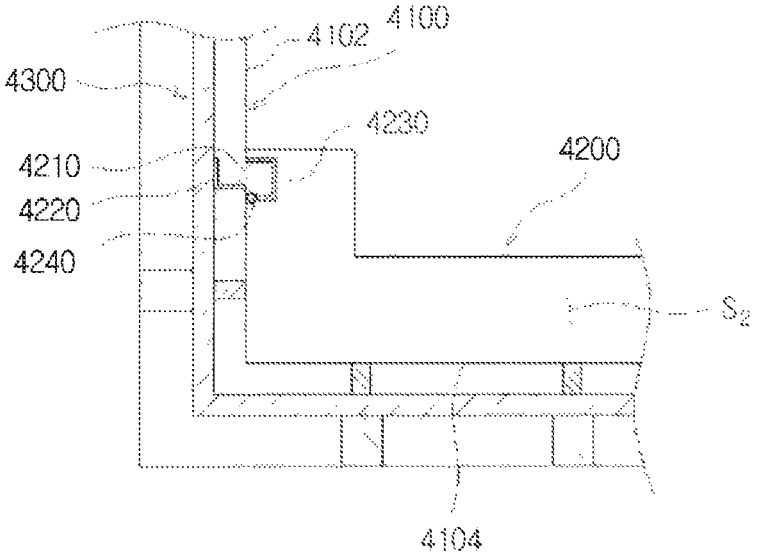
FIG. 12 is an enlarged sectional view of the edge where an inflow hole is formed, in still another modified liquid cargo storage tank according to the fourth embodiment of the present invention.

FIG. 12 is an enlarged sectional view of the edge, where inflow holes 4210 are formed, in still another modified liquid cargo storage tank according to the fourth embodiment of the present invention. In this embodiment, all elements are identical to those in the fourth embodiments of the present invention, except a check valve 4240 formed at the shielding member 4230.

The check valve 4240 can be installed at a part of the lower part of the opening of the shielding member 4230 to allow the flow in only one direction. Thus, the check valve 4240 of this embodiment allows the flow of the leaked liquid only from the outer side to the inner side of the inflow hole 4210.

It is apparent that the check valve be installed in the inflow hole in the other embodiments described above but it is not easy to install the check valve since the space between the body and the insulation member is very narrow. However, in this embodiment, a space can be secured enough to install the check valve 4240 by exposing to the leaked liquid collecting space S2 of the inner side of the inflow hole 4210.

Installing the check valve 4240 is facilitated since the shielding member 4230 is provided at the inner side of the inflow hole 4210. Particularly, the shielding member 4230 is exposed to the leaked liquid collecting space S2 and a part of the lower part is only opened so that not only the check valve 4240 can be installed by utilizing the space of the leaked liquid collecting space S2 but also the flow of the leaked liquid can be controlled with the narrow opening area.

In this embodiment, the check valve 4240 can be a solenoid valve. The inlet part of the shielding member 4230 can be controlled by an electric current through a solenoid.

Here, the liquid cargo storage tank of the present invention may further comprise a controlling part (not shown) to control the operation of the check valve 4240.

In addition, the supporting member 4250 (not shown) can be installed in the embodiments in FIG. 11 and FIG. 12 as installed in the FIG. 9 and FIG. 10 and further the inflow hole 4252 can be formed at the supporting member 4250.

While liquid cargo storage tanks and ship including the same have been described with reference to particular embodiments, it is to be appreciated that various changes and modifications may be made by those skilled in the art without departing from the spirit and scope of the embodiment herein, as defined by the appended claims and their equivalents.

What is claimed is:

1. A liquid cargo storage tank comprising:

a body installed in a hull of a ship and having a liquid cargo receiving space formed therein, the body forming a space between the body and the hull;

a reinforcing plate installed in a lower part of the body, the reinforcing plate being spaced apart from an underside of the body to be a floor of the liquid cargo receiving space;

a leaked liquid collecting space formed between the underside of the body and the reinforcing plate to collect the liquid cargo leakage leaked from the liquid cargo receiving space to the leaked liquid collecting space;

inflow holes formed on lateral sides of the leaked liquid collecting space and connected to the space to let the liquid cargo leakage leaked to the outside of the body inflow to the leaked liquid collecting space;

a blocking door installed at each of the inflow holes to control flow of a leaked liquid cargo; and a driving part to selectively open and close the blocking door.

2. The liquid cargo storage tank according to claim 1, further comprising an insulation member wrapping around the body, the insulation member being spaced apart from the body on an outside of the body, wherein the space forms a flow path to flow a liquid cargo leakage leaked to the outside of the body.

3. The liquid cargo storage tank according to claim 1, further comprising drip trays installed in the space to collect the liquid cargo leakage leaked to the space from the liquid cargo receiving space.

4. The liquid cargo storage tank according to claim 1, further comprising a sensor installed at the body to detect leakage of the liquid cargo, and a controlling part to control the driving part to selectively open and close the blocking door according to information from the sensor.

5. The liquid cargo storage tank according to claim 1, further comprising a shielding member installed at an inner side of the leaked liquid collecting space to shield a top side and a lateral side of an inner side of the inflow hole.

6. The liquid cargo storage tank according to claim 5, wherein the shielding member further shield a part of a bottom of the inner side of the inflow hole.

7. The liquid cargo storage tank according to claim 1, further comprising a guiding member installed at an outer side of the inflow hole to guide the leaked liquid cargo to the inflow holes.

8. The liquid cargo storage tank according to claim 1, further comprising a supporting member installed between the reinforcing plate and the lower inner underside of the body to let the reinforcing plate and the lower inner underside of the body support each other.

9. The liquid cargo storage tank according to claim 8, wherein a leaked liquid collecting space is formed between the underside of the body and the reinforcing plate to collect the liquid cargo leakage leaked from the liquid cargo receiving space to the leaked liquid collecting space, and inflow holes are formed at the supporting member to let the collected liquid cargo leakage flow therethrough.

10. The liquid cargo storage tank according to claim 1, wherein an oblique inclined part is formed between a lateral side of the body and an underside part of the body.

11. A ship comprising a liquid cargo storage tank, wherein the liquid cargo storage tank comprises:

a body installed in a hull of a ship and having a liquid cargo receiving space formed therein, the body forming a space between the body and the hull;

a reinforcing plate installed in a lower part of the body, the reinforcing plate being spaced apart from an underside of the body to be a floor of the liquid cargo receiving space;

a leaked liquid collecting space formed between the underside of the body and the reinforcing plate to collect the liquid cargo leakage leaked from the liquid cargo receiving space to the leaked liquid collecting space;

inflow holes formed on lateral sides of the leaked liquid collecting space and connected to the space to let the liquid cargo leakage leaked to the outside of the body inflow to the leaked liquid collecting space;

a blocking door installed at each of the inflow holes to control flow of a leaked liquid cargo; and a driving part to selectively open and close the blocking door.

12. The ship according to claim 11, wherein the liquid cargo storage tank further comprises an insulation member wrapping around the body, the insulation member being spaced apart from the body on an outside of the body, and wherein the space forms a flow path to flow a liquid cargo leakage leaked to the outside of the body.

13. The ship according to claim 11, wherein the liquid cargo storage tank further comprises drip trays installed in the space to collect the liquid cargo leakage leaked to the space from the liquid cargo receiving space.

14. The ship according to claim 11, wherein the liquid cargo storage tank further comprises a supporting member installed between the reinforcing plate and the lower inner underside of the body to let the reinforcing plate and the underside of the body support each other.

15. The ship according to claim 11, wherein an oblique inclined part is formed between a lateral side of the body and the underside of the body.

* * * * *